US009172152B2

(12) United States Patent
Matoba et al.

(10) Patent No.: US 9,172,152 B2
(45) Date of Patent: Oct. 27, 2015

(54) PRESSURE WELDING TERMINAL

(71) Applicant: OMRON Corporation, Kyoto-shi, Kyoto (JP)

(72) Inventors: Masato Matoba, Kawasaki (JP); Shunsuke Akahori, Kawasaki (JP)

(73) Assignee: OMRON Corporation, Kyoto (JP)

( * ) Notice: Subject to any disclaimer, the term of this patent is extended or adjusted under 35 U.S.C. 154(b) by 101 days.

(21) Appl. No.: 13/899,489

(22) Filed: May 21, 2013

(65) Prior Publication Data

US 2013/0323988 A1 Dec. 5, 2013

(30) Foreign Application Priority Data

May 31, 2012 (JP) ..... 2012-124639

(51) Int. Cl.
*H01R 4/24* (2006.01)
*H01R 4/48* (2006.01)

(52) U.S. Cl.
CPC ..... *H01R 4/48* (2013.01); *H01R 4/2433* (2013.01)

(58) Field of Classification Search
CPC ..... H01R 4/2429
USPC ..... 439/395
See application file for complete search history.

(56) References Cited

U.S. PATENT DOCUMENTS

| | | | | | |
|---|---|---|---|---|---|
| 3,605,072 | A * | 9/1971 | Driscoll | 439/402 |
| 4,019,800 | A * | 4/1977 | Soes | 439/395 |
| 4,548,459 | A * | 10/1985 | Mosser, III | 439/443 |
| 5,681,180 | A * | 10/1997 | Rodrigues | 439/404 |
| 5,683,267 | A * | 11/1997 | Ribbeck et al. | 439/395 |
| 5,685,733 | A * | 11/1997 | Janczak | 439/395 |
| 6,364,690 | B1 | 4/2002 | Nehm-Engelberts | |
| 7,255,591 | B2 * | 8/2007 | Schreier | 439/412 |
| 8,105,105 | B2 * | 1/2012 | Taniguchi et al. | 439/395 |
| 2006/0089040 | A1 | 4/2006 | Pratt | |

FOREIGN PATENT DOCUMENTS

| | | | |
|---|---|---|---|
| EP | 0 653 804 | A1 | 5/1995 |
| JP | 2000-294307 | A | 10/2000 |
| JP | 2005-166653 | A | 6/2005 |
| JP | 2011-204399 | A | 10/2011 |

* cited by examiner

*Primary Examiner* — Neil Abrams
(74) *Attorney, Agent, or Firm* — Klarquist Sparkman, LLP

(57) ABSTRACT

Embodiments of pressure welding terminals are provided including a pair of spring portions and a slit for press-fitting and retaining a conductive body disposed between the pair of spring portions by a fixed push-in amount. An upper edge of the conductive body is retained by the slit at a fixed position from an opening of the slit, and a region is provided where an area of a cross section of at least one of the spring portions on the lower side of the upper edge of the conductive body is smaller than an area of a cross section of the at least one spring portion at a position of the upper edge of the conductive body.

14 Claims, 10 Drawing Sheets

PRESSURE WELDING TERMINAL

CROSS REFERENCE TO RELATED APPLICATION

This application claims the benefit of priority from Japanese Patent Application No. 2012-124639, filed on May 31, 2012, the entire contents of which is incorporated herein by reference.

BACKGROUND

The present invention relates to a pressure welding terminal for press-fitting and connecting an electric wire or the like into a U shape press-fit slit, for example, in trunk connection of a sensor and the like.

Conventionally, in order to use for a connector for connecting an electric wire, various terminals for pressure-welding a plurality of electric wires having different diameters are proposed. For example, Japanese Unexamined Patent Publication No. 2005-166653 describes a connector using a pressure welding terminal in which a slit is formed with a fixed width as such a terminal. However, with this pressure welding terminal, in the case where an electric wire having a small diameter is pressure-welded, there is a problem that a pressure welding force is insufficient and contact reliability is not obtained. On the other hand, in the case where an electric wire having a large diameter is pressure-welded, there is a problem that the pressure welding terminal is plastically deformed or the pressure welding force becomes too strong and the electric wire is cut.

Further, Japanese Unexamined Patent Publication No. 2000-294307 proposes a pressure welding terminal clamp in which a blank portion is opened on the side of an electric wire press-fit groove. However, with this pressure welding terminal clamp, a pressure welding portion is provided between both left and right side walls. Thus, the pressure welding portion is not easily deformed, so that an electric wire having a larger diameter than width between the electric wire press-fit groove and the blank portion cannot be press-fitted.

Japanese Unexamined Patent Publication No. 2011-204399 describes a pressure welding terminal having a slot formed so that width is narrowed down stepwise. However, with this pressure welding terminal, when electric wires having different diameters are press-fitted into the slot, a push-in amount from an opening is different. Thus, there is a problem that the pressure welding terminal cannot be applied to a pressure welding terminal used for a connector in which a push-in amount is fixed.

SUMMARY

The present invention has been devised to solve the conventional problems described above, and an object thereof is to provide a pressure welding terminal capable of pressure-welding and retaining a plurality of types of electric wires having different diameters by a fixed push-in amount at predetermined pressure.

In one embodiment of the present invention, in order to solve the above problems, the present invention provides a pressure welding terminal comprising: a pair of spring portions; a slit for press-fitting and retaining a conductive body disposed between said pair of spring portions and an upper edge of the conductive body, the conductive body retained by the slit disposed at a fixed position from an opening of the slit, wherein a region where an area of a cross section of the spring portions is arranged on the lower side of the upper edge of the conductive body, and at least one of the pair of spring portions is smaller than an area of a cross section of the spring portions at a position on the upper edge of the conductive body.

In the pressure welding terminal for press-fitting and retaining the conductive body so that the upper edge of the conductive body is always placed at the same position, a plurality of types of conductive bodies having different diameters can be pressure-welded only by the spring portions or by the spring portions and the part where the area of the cross section of the spring portions is reduced with a desired retaining force.

Specifically, in the case where a conductive body having a smaller diameter than standard is press-fitted into the pressure welding terminal, only the spring portions are elastically deformed and the conductive body is pressure-welded by a reactive force thereof. Thus, a sufficient pressure welding force can be obtained. Meanwhile, in the case where a conductive body having a standard diameter and a conductive body having a larger diameter than standard are press-fitted into the pressure welding terminal, the part where the area of the cross section is reduced is elastically deformed in addition to the spring portions. However, in the case where the conductive body having a large diameter is press-fitted, the part where the area of the cross section is reduced is more largely elastically deformed in comparison to a case where the conductive body having a standard diameter is press-fitted. Therefore, by elastically deforming the part where the area of the cross section is reduced, stress of the spring portions can be decreased, so that plastic deformation can be prevented.

Since the stress of the spring portions can be decreased, contact reliability at the time of repeating a press-fit task can be ensured. Further, a plurality of types of conductive bodies having different diameters can be pressure-welded by one type of pressure welding terminal, so that stock management is easily performed.

As described above, there is no need for changing a push-in amount in accordance with a diameter difference of the conductive body or preparing a plurality of pressure welding terminals of different pressure welding forces. Thus, there is no need for changing a shape of a housing in correspondence with the diameter of the conductive body or preparing jigs for pushing the conductive body.

In another embodiment of the present invention, the slit may include a first slit having the opening in one end, and a second slit extending from the other end of the first slit and widening toward the far side.

With the above configuration, by pressure-welding the conductive body having a small diameter by the first slit and pressure-welding the conductive body having a large diameter by the second slit, the conductive bodies having different diameters can be pressure-welded with a desired retaining force. By arbitrarily setting width of the first slit and the second slit according to the diameter of the conductive body to be pressure-welded, a pressure welding force is prevented from becoming excessive at the time of pressure-welding the conductive body having a large diameter. Therefore, a push-in force at the time of inserting the conductive body into the slit is reduced, so that assembling workability can be improved.

In another embodiment of the present invention, a hole portion extending along the slit may be provided, and a pressure welding portion for pressure-welding the conductive body may be formed between the hole portion and the slit. Thereby, the pressure welding portion is easily elastically deformed. Thus, in the case where the conductive body having a large diameter is press-fitted into the pressure welding terminal, an excessive pressure welding force applied to the conductive body can be reduced.

In still another embodiment of the present invention, a narrow neck portion cut out inward from an outer edge of the spring portion may be provided, and a pressure welding portion for pressure-welding the conductive body may be formed on the upper side of the narrow neck portion. Thereby, when the conductive body is pressure-welded, the narrow neck portion is elastically deformed in addition to the spring portions. Thus, an excessive pressure welding force applied to the conductive body in the case where the conductive body having a large diameter is press-fitted into the pressure welding terminal can be reduced.

In a further embodiment of the present invention, a connector may include the pressure welding terminal. Thereby, a plurality of types of conductive bodies having different diameters can be pressure-welded by one type of pressure welding terminal, so that the connector with which stock management is easily performed is obtained.

BRIEF DESCRIPTION OF THE DRAWINGS

FIG. 1C is a perspective view in which the pressure welding terminals of FIG. 1A are seen from the upper side;

DETAILED DESCRIPTION

Embodiments of a pressure welding terminal according to the present invention will be described in accordance with the attached drawings of FIGS. 1A to 13B.

A first embodiment is a case where pressure welding terminals 31 of the present invention are applied to a connector 10 formed by coupling a plug 11 and a socket 21 as shown in FIGS. 1A to 1C and FIG. 2.

Figure 1A:
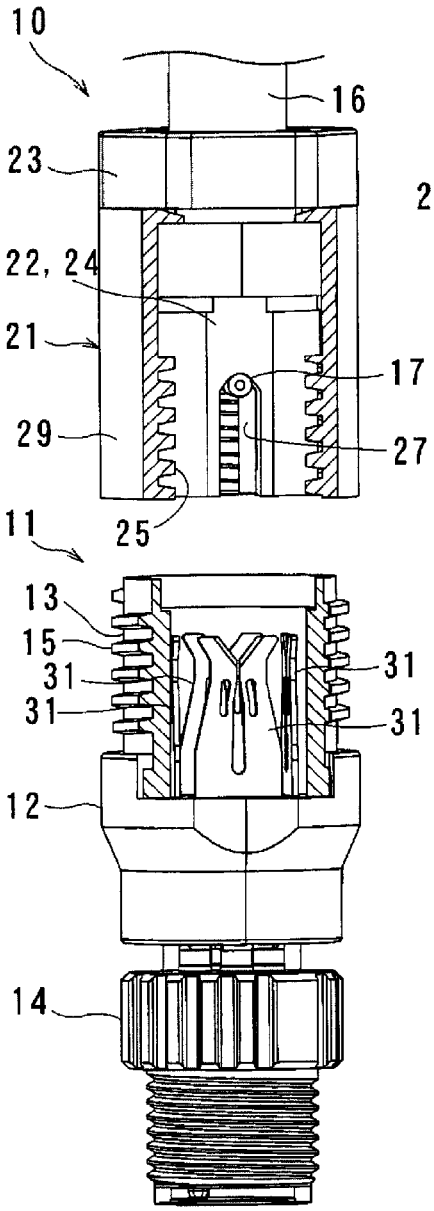
FIG. 1A is a partially broken perspective view showing a connector in a state that a plug in which pressure welding terminals according to a first embodiment of the present invention are assembled is separated from a socket.
Figure 1B:
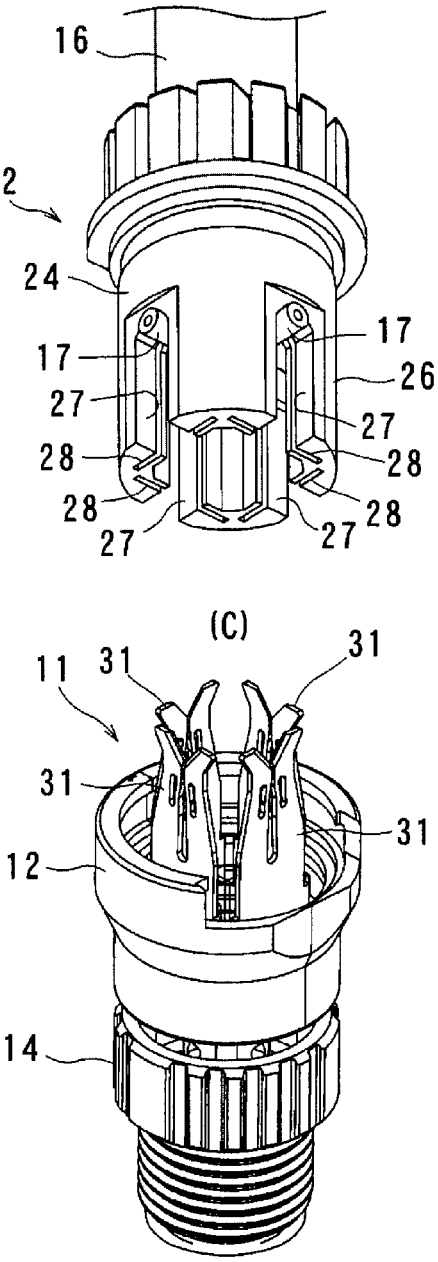
FIG. 1B is a perspective view in which a socket main body of FIG. 1A is seen from the lower side.

The plug 11 includes a cylindrical plug main body 12, a cylindrical plug housing 13 engaged with the plug main body 12 so as to extend upward, and a fastening portion 14 for fastening a cable (not shown) on the lower end side of the plug main body 12. Inside the plug main body 12, four pressure welding terminals 31 according to the present invention are arranged and fixed so as to respectively form one side of a regular square (refer to FIG. 1C), and electrically connected to the cable. As shown in FIG. 1A, a male screw 15 is formed on an outer circumference of the plug housing 13. It should be noted that in FIG. 1C, the plug housing 13 is omitted for convenience of description.

The socket 21 includes a cylindrical socket main body 22 provided inside, a retaining portion 23 fixed on the upper side of the socket main body 22, and a cylindrically screwing portion 29 rotatably arranged on an outer circumference of the socket main body 22. On the lower side of the socket main body 22, a cable retaining body 24 for retaining electric wires (conductive bodies) 17 forming a cable 16 is formed (refer to FIG. 1B). The cable retaining body 24 is formed in a cylindrical shape, and inside thereof, four electric wires 17 diverge and extend outward from the center of the cable 16. It should be noted that in FIG. 1B, the retaining portion 23 and the screwing portion 29 are omitted for convenience of description. On a peripheral wall 26 of the cable retaining body 24, retaining grooves 27 for locking and retaining the electric wires 17 at upper ends are formed. On the peripheral wall 26 of the cable retaining body 24, insertion slits 28 for inserting the pressure welding terminals 31 at the time of coupling the plug 11 and the socket 21 are formed in the vertical direction along the retaining grooves 27. Further, a female screw 25 is formed on an inner peripheral surface of the screwing portion 29, so as to be screwed onto the male screw 15 of the plug main body 12.

Figure 2:
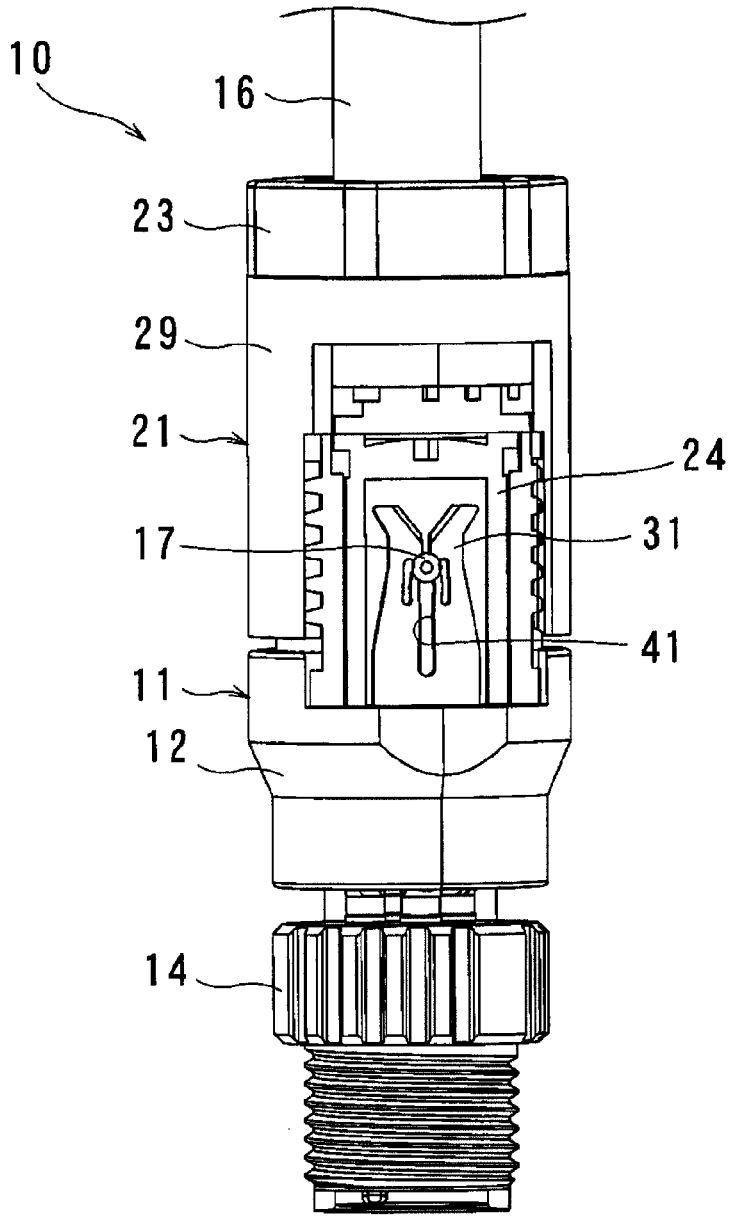
FIG. 2 is a partially broken perspective view showing the connector in a state that the plug and the socket of FIG. 1A are connected.

In order to couple the plug 11 and the socket 21, the pressure welding terminals 31 are inserted into the insertion slits 28 of the cable retaining body 24, and the plug housing 13 is fitted inside the screwing portion 29. By retaining the retaining portion 23 of the socket 21, rotating the screwing portion 29, and screwing the male screw 15 and the female screw 25, the cable retaining body 24 moves toward the pressure welding terminals 31. Thereby, as shown in FIG. 2, the plug 11 and the socket 21 are coupled, and the electric wires 17 are pressure-welded to press-fit slits 41 of the pressure welding terminals 31 to be described later and electrically connected. At this time, in a state that the plug 11 and the socket 21 are coupled to each other, irrespective of a diameter of the electric wires 17, upper edges of the electric wires 17 are always pushed in from openings 42 of the press-fit slits 41 by a fixed distance L1 (refer to FIGS. 5 to 7).

Figure 3A:
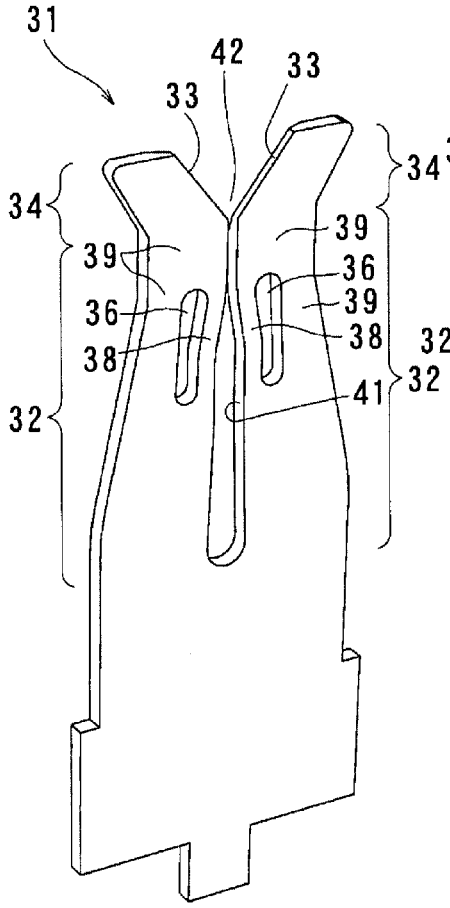
FIG. 3A is a perspective view of the pressure welding terminal according to the first embodiment of the present invention.
Figure 3B:
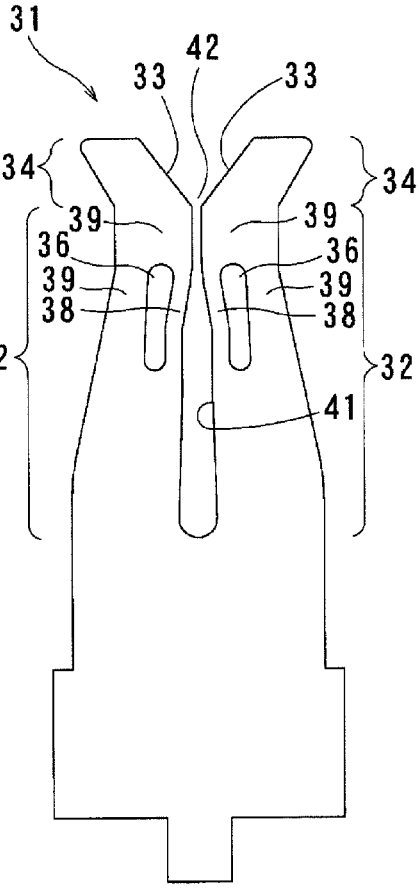
FIG. 3B is a front view of FIG. 3A.

As shown in FIGS. 3A and 3B, the pressure welding terminal 31 includes a pair of symmetrically formed spring portions 32, 32, and the substantially U shape press-fit slit 41 formed between the pair of spring portions 32, 32 for press-fitting and retaining the electric wire 17 from the opening 42.

Figure 4:
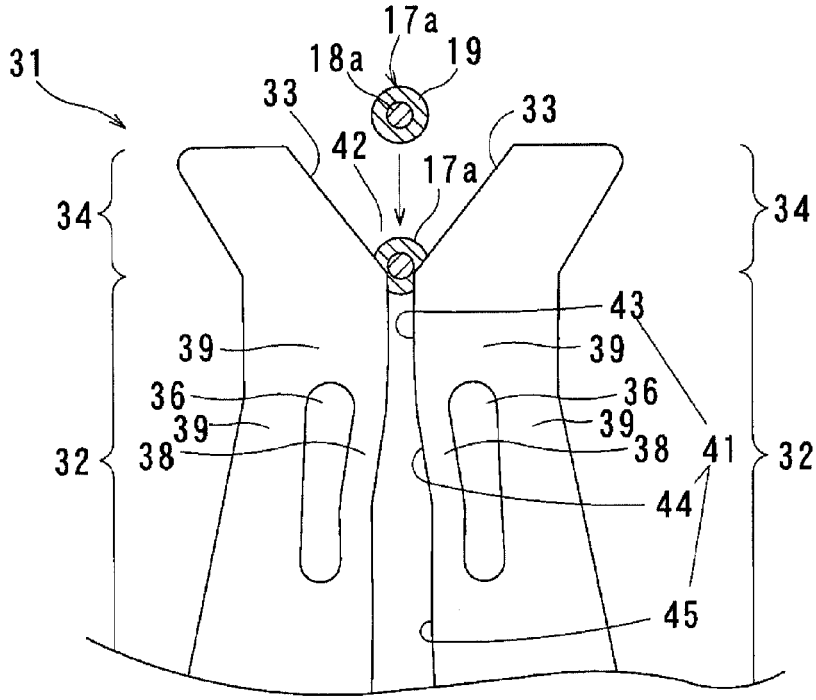
FIG. 4 is a front view of the middle of press-fitting an electric wire having a smaller diameter than standard into the pressure welding terminal of FIGS. 3A and 3B.

The spring portion 32 is a plate shape elastic body extending vertically and being formed so that width becomes the same or larger from the opening 42 toward the lower side. The spring portion includes a first pressure welding portion 39 for pressure-welding the electric wire 17. As shown in FIG. 4, a deviated portion 34 extends obliquely outward from an upper end of the spring portion 32. On an inside surface of the deviated portion 34, a deleting taper surface 33 for deleting a covering layer 19 of the electric wire 17 is formed. In the spring portion 32, a hole portion 36 is formed along the press-fit slit 41. An upper end of this hole portion 36 is formed on the lower side of the upper edge of the electric wire 17 to be described later. A shape of the hole portion 36 is set so that a region where an area of a cross section of the spring portions 32 at the hole portions 36 is smaller than an area of a cross section of the spring portions 32 at a position of the upper edge of the electric wire 17.

The press-fit slit 41 has a first slit 43, a second slit 44, and a third slit 45 in order from the opening 42 toward the lower side. In the first slit 43, the opening 42 is formed in an upper end and width is narrow and fixed. The second slit 44 extends from a lower end of the first slit 43 and inclines so as to widen toward the lower side, and an area of a cross section of the spring portions 32 is reduced. A second pressure welding portion 38 is provided between the second slit 44 and the hole portion 36. The third slit 45 extends downward from a lower end of the second slit 44, and width is larger than the first slit 43 and fixed. It should be noted that the second pressure welding portion 38 is provided between the second slit 44 and the hole portion 36 or between the second slit 44 and the third slit 45 and the hole portion 36, so that the electric wire 17 can be pressure-welded by the first pressure welding portion 39 and the second pressure welding portion 38 sandwiching the hole portion 36.

Next, an action of press-fitting the electric wire 17 into the press-fit slit 41 will be described.

The electric wire 17 (17*a*, 17*b*, 17*c*) includes a solid wire 18 (18*a*, 18*b*, 18*c*) having conductivity, and the covering layer 19 made of a resin material for covering an outer circumference of this solid wire 18. However, the electric wire 17 is not limited to the above configuration but a solid wire formed by a plurality of twist wires may be used or the electric wire may be a bare wire having no covering layer 19.

Figure 5:
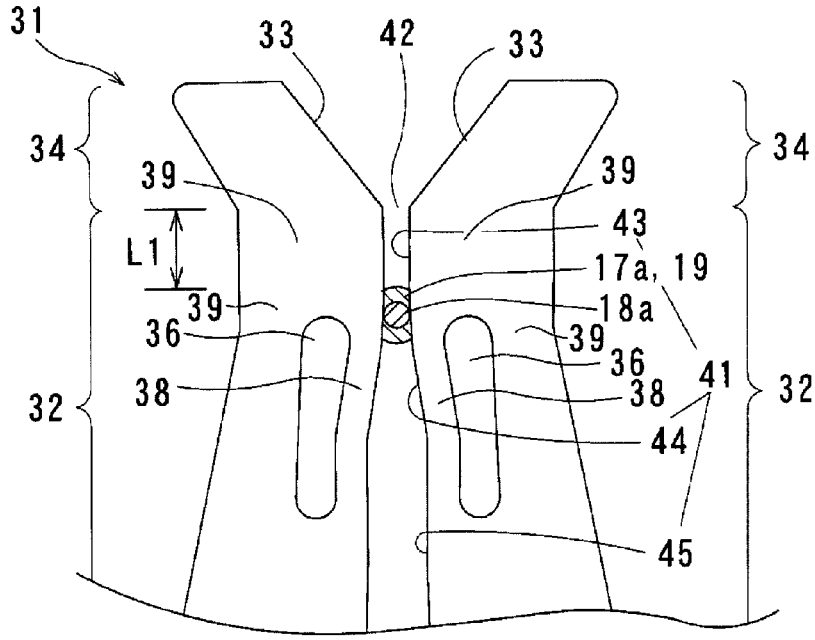
FIG. 5 is a front view of a state that press-fit of the electric wire having a smaller diameter than standard into the pressure welding terminal of FIG. 4 is completed.

The electric wire 17 may have variously different diameters. Firstly, as shown in FIG. 4, a case where an electric wire 17*a* having a smaller diameter than standard is press-fitted into the pressure welding terminal 31 will be described. When the electric wire 17*a* is press-fitted from the upper side of the press-fit slit 41, firstly, the covering layer 19 is deleted by the deleting taper surface 33 and a solid wire 18*a* is exposed. Further, when the electric wire 17*a* is press-fitted toward the lower side of the press-fit slit 41, the solid wire 18*a* is led to the lower side from the opening 42 while applying a force in the direction in which the first slit 43 is pushed and expanded outward. As shown in FIG. 5, the electric wire 17*a* press-fitted into the press-fit slit 41 is retained at a position where an upper edge thereof is pushed in downward from the opening 42 by the distance L1. At this time, the solid wire 18*a* applies the force in the direction in which the entire spring portions 32 are pushed and expanded outward via the first slit 43, and is pressure-welded by a reactive force from the first pressure welding portions 39 provided in the spring portions 32 and electrically connected.

Figure 6:
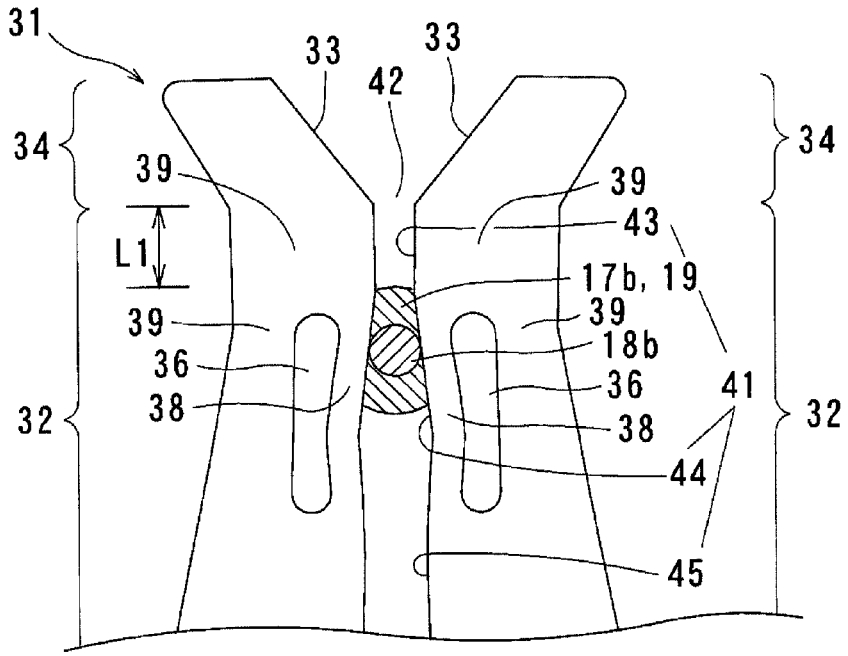
FIG. 6 is a front view of a state that press-fit of an electric wire having a standard diameter into the pressure welding terminal of FIGS. 3A and 3B is completed.

Similarly, as shown in FIG. 6, when an electric wire 17*b* having a standard diameter is press-fitted into the pressure welding terminal 31, the electric wire 17*b* is retained at a position where an upper edge thereof is pushed in downward from the opening 42 by the distance L1. At this time, a solid wire 18*b* press-fitted into the press-fit slit 41 applies a force in the direction in which the first pressure welding portions 39 and the second pressure welding portions 38 are pushed and expanded outward via the second slit 44. Therefore, the solid wire 18*b* is pressure-welded by a reactive force from the first pressure welding portions 39 and the second pressure welding portions 38 and electrically connected.

Figure 7:
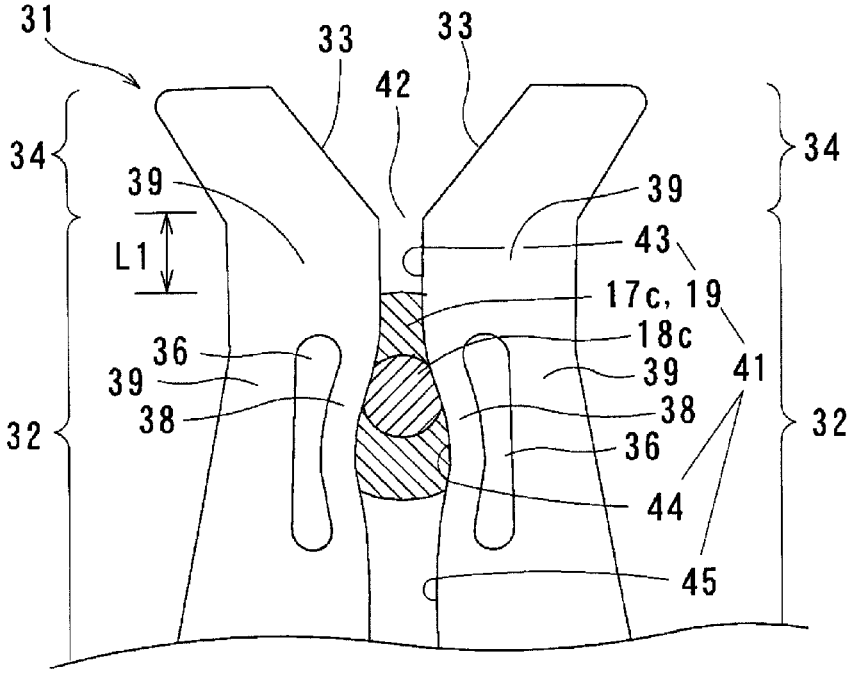
FIG. 7 is a front view of a state that press-fit of an electric wire having a larger diameter than standard into the pressure welding terminal of FIGS. 3A and 3B is completed.

Similarly, as shown in FIG. 7, when an electric wire 17*c* having a diameter larger than standard is press-fitted into the pressure welding terminal 31, the electric wire 17*c* is retained at a position where an upper edge thereof is pushed in downward from the opening 42 by the distance L1. A solid wire 18*c* press-fitted into the press-fit slit 41 applies a force in the direction in which the first pressure welding portions 39 and the second pressure welding portions 38 provided in the spring portions 32 are pushed and expanded outward via the second slit 44. At this time, since the hole portions 36 are provided, the second pressure welding portions 38 are furthermore deformed in comparison to a case where the electric wire 17*b* having a standard diameter is press-fitted. That is, the reactive force receiving from the first pressure welding portions 39 can be eased. Thus, an excessive pressure welding force applied to the electric wire 17*c* in the case where the electric wire 17*c* having a large diameter is press-fitted into the pressure welding terminal 31 can be reduced, so that the solid wire 18*c* is pressure-welded by the reactive force from the second pressure welding portions 38 and the eased reactive force from the first pressure welding portions 39 and electrically connected.

As described above, in the case where the electric wire 17*a* having a smaller diameter than standard is press-fitted into the pressure welding terminal 31, only the first pressure-welding portions 39 provided in the spring portions 32 are deformed and the electric wire 17*a* is pressure-welded by the reactive force of the first pressure-welding portions 39. Thus, a sufficient pressure welding force can be obtained. In the case where the electric wire 17*b* having a standard diameter and the electric wire 17*c* having a diameter larger than standard are press-fitted into the pressure welding terminal 31, the second pressure-welding portions 38 are deformed in addition to the first pressure-welding portions 39. Further, in the case where the electric wire 17*c* having a diameter larger than standard is press-fitted, the second pressure-welding portions 38 are more largely deformed in comparison to a case where the electric wire 17*b* having a standard diameter is press-fitted. Therefore, an excessive pressure welding force applied to the electric wire 17*c* can be reduced, so that contact reliability at the time of repeating a pressure welding task can be ensured. Further, since the first pressure-welding portions 39 and the second pressure-welding portions 38 are deformed, plastic deformation due to too much deformation of only the first pressure-welding portions 39 and concentration of stress can be prevented. Therefore, a plurality of types of electric wires having different diameters can be pressure-welded by one type of pressure welding terminal 31. Thus, there is no need for preparing pressure welding terminals 31 of different pressure welding forces in correspondence with a wire diameter, so that stock management is easily performed.

Since the push-in amount L1 of the electric wires 17*a*, 17*b*, 17*c* into the press-fit slit 41 is always fixed, positions of the electric wires 17*a*, 17*b*, 17*c* at the time of completion of pressure-welding are always fixed according to the diameters of the electric wires 17*a*, 17*b*, 17*c* to be pressure-welded. Therefore, a deformation amount of the second pressure-welding portions 38 can be arbitrarily set so as to deform only the first pressure-welding portions 39 or the first pressure-welding portions 39 and the second pressure-welding portions 38.

Further, while the electric wire 17*a* having a small diameter is pressure-welded by the first slit 43, the electric wire 17*c* having a large diameter is pressure-welded by the second slit 44. Thus, the electric wires 17 having different diameters can be pressure-welded with a desired retaining force. Width of the first slit 43 and the second slit 44 may be arbitrarily set according to the diameter of the electric wire 17 to be pressure-welded. Thereby, a pressure welding force can be prevented from becoming excessive at the time of pressure-welding the electric wire 17*c* having a large diameter, and a push-in force at the time of inserting the electric wire 17*c* into the press-fit slit 41 can be reduced, so that assembling workability can be improved.

Figure 8A:
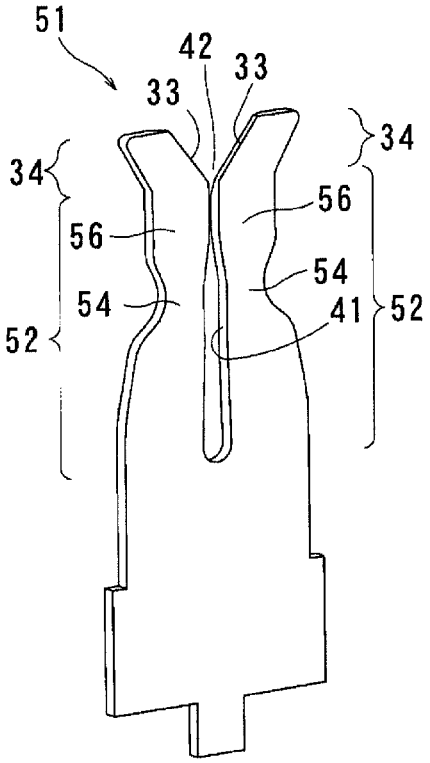
FIG. 8A is a perspective view of a pressure welding terminal according to a second embodiment of the present invention.
Figure 8B:
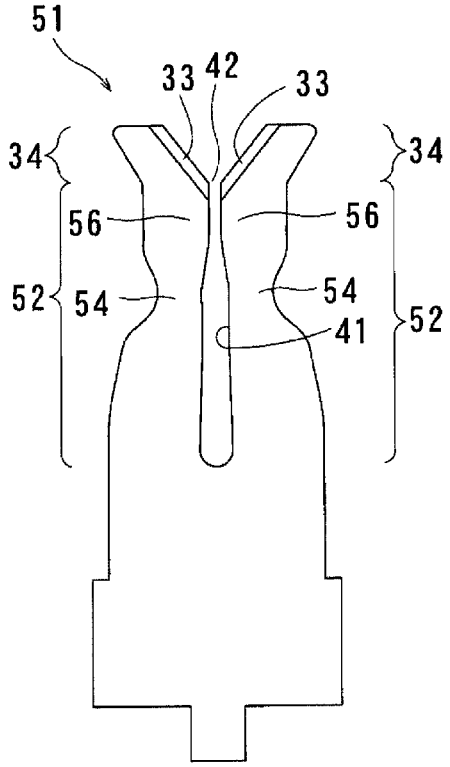
FIG. 8B is a front view of FIG. 8A.

As shown in FIGS. 8A and 8B, a pressure welding terminal 51 according to a second embodiment of the present invention includes a pair of symmetrically formed spring portions 52, 52, and a substantially U shape press-fit slit 41 formed between the pair of spring portions 52, 52 for press-fitting and retaining an electric wire 17 from an opening 42.

The spring portion 52 is a plate shape elastic body extending vertically from the opening 42 of the press-fit slit 41 to a far-side end. In the substantially center of the spring portion 52, a narrow neck portion 54 cut out so that an outer edge is curved inward is provided, and a cross-sectional area of the spring portion 52 is reduced. On the upper side of the narrow neck portion 54 of the spring portion 52, a pressure-welding portion 56 to be deformed from the narrow neck portion 54 and warped outward when the electric wire 17 having a predetermined diameter is press-fitted so as to pressure-weld and retain the electric wire 17 is formed. The other parts are the same as the first embodiment. Thus, the same parts will be given the same reference signs and description thereof will be omitted.

Next, an action of press-fitting the electric wire 17 into the pressure welding terminal 51 will be described.

Figure 9:
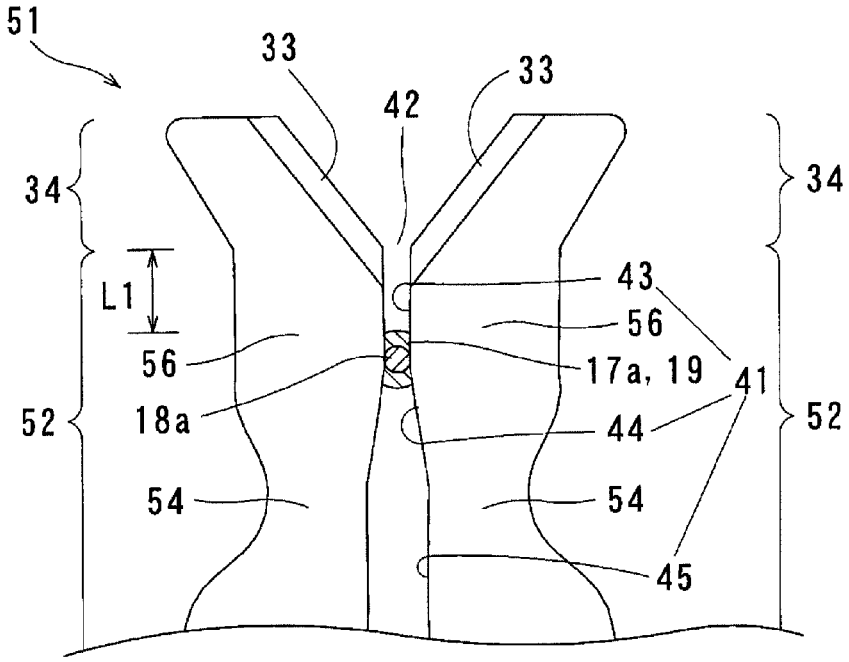
FIG. 9 is a front view of a state that press-fit of an electric wire having a smaller diameter than standard into the pressure welding terminal of FIGS. 8A and 8B is completed.

As shown in FIG. 9, when an electric wire 17*a* having a smaller diameter than standard is press-fitted into a press-fit slit 41, the electric wire 17*a* is retained at a position where an upper edge thereof is pushed in downward from the opening 42 by a distance L1. At this time, a solid wire 18*a* applies a force in the direction in which the entire spring portions 52 are pushed and expanded outward via a first slit 43, and is pressure-welded by a reactive force from the pressure welding portions 56 provided in the spring portions 52 and electrically connected.

Figure 10:
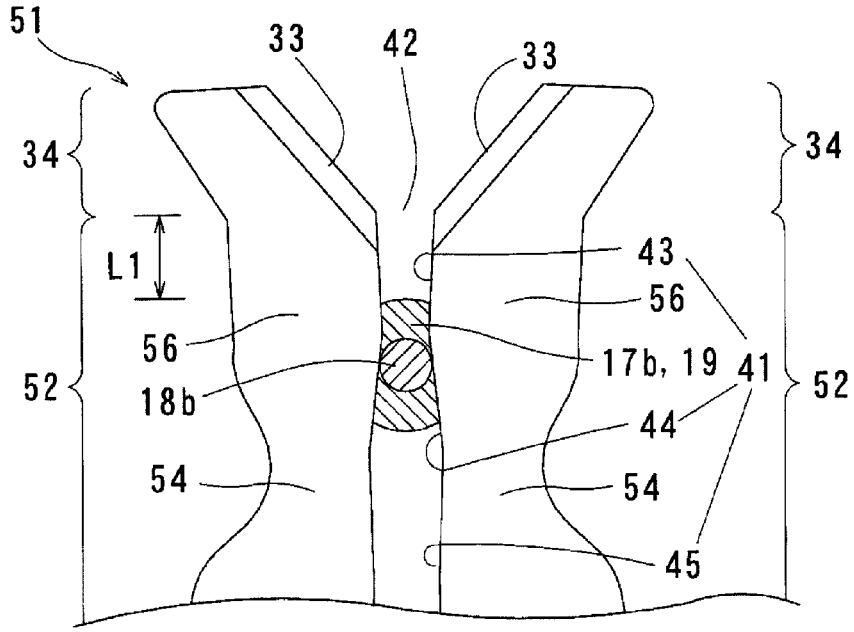
FIG. 10 is a front view of a state that press-fit of an electric wire having a standard diameter into the pressure welding terminal of FIGS. 8A and 8B is completed.

Similarly, as shown in FIG. 10, when an electric wire 17*b* having a standard diameter is press-fitted into the pressure welding terminal 51, the electric wire 17*b* is retained at a position where an upper edge thereof is pushed in downward from the opening 42 by the distance L1. At this time, a solid wire 18*b* press-fitted into the press-fit slit 41 applies a force in the direction in which the spring portions 52 and the pressure welding portions 56 are pushed and expanded outward via a second slit 44. Thus, the spring portions 52 and the narrow neck portions 54 are deformed. Therefore, the solid wire 18*b* is pressure-welded by a reactive force of the pressure-welding portions 56 and the narrow neck portions 54 provided in the spring portions 52 and electrically connected.

Figure 11:
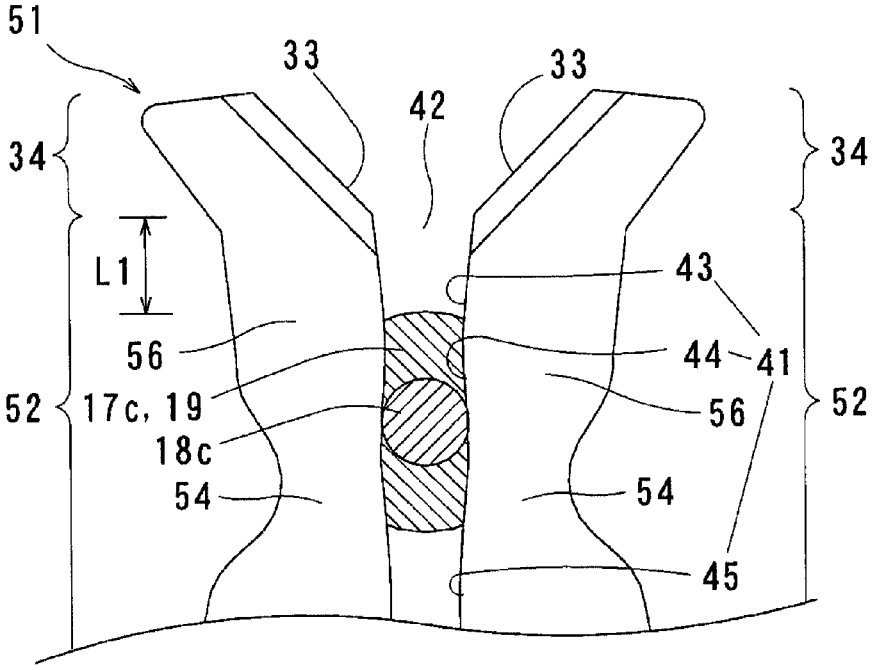
FIG. 11 is a front view of a state that press-fit of an electric wire having a larger diameter than standard into the pressure welding terminal of FIGS. 8A and 8B is completed.

Similarly, as shown in FIG. 11, when an electric wire 17*c* having a diameter larger than standard is press-fitted into the pressure welding terminal 51, the electric wire 17*c* is retained at a position where an upper edge thereof is pushed in downward from the opening 42 by the distance L1. At this time, a solid wire 18*c* press-fitted into the press-fit slit 41 applies a force in the direction in which the spring portions 52 and the pressure welding portions 56 are pushed and expanded outward via the second slit 44. Thus, the spring portions 52 and the narrow neck portions 54 are deformed. It should be noted that since the narrow neck portions 54 are more largely deformed outward in comparison to a case where the electric wire 17*b* having a standard diameter is press-fitted, the pressure-welding portions 56 move outward more largely. Therefore, an excessive pressure welding force applied to the electric wire 17*c* in the case where the electric wire 17*c* having a large diameter is press-fitted into the pressure welding terminal 51 can be reduced. The solid wire 18*c* is pressure-welded by the reactive force of the pressure-welding portions 56 and the narrow neck portions 54 provided in the spring portions 52 and electrically connected.

Figure 12:
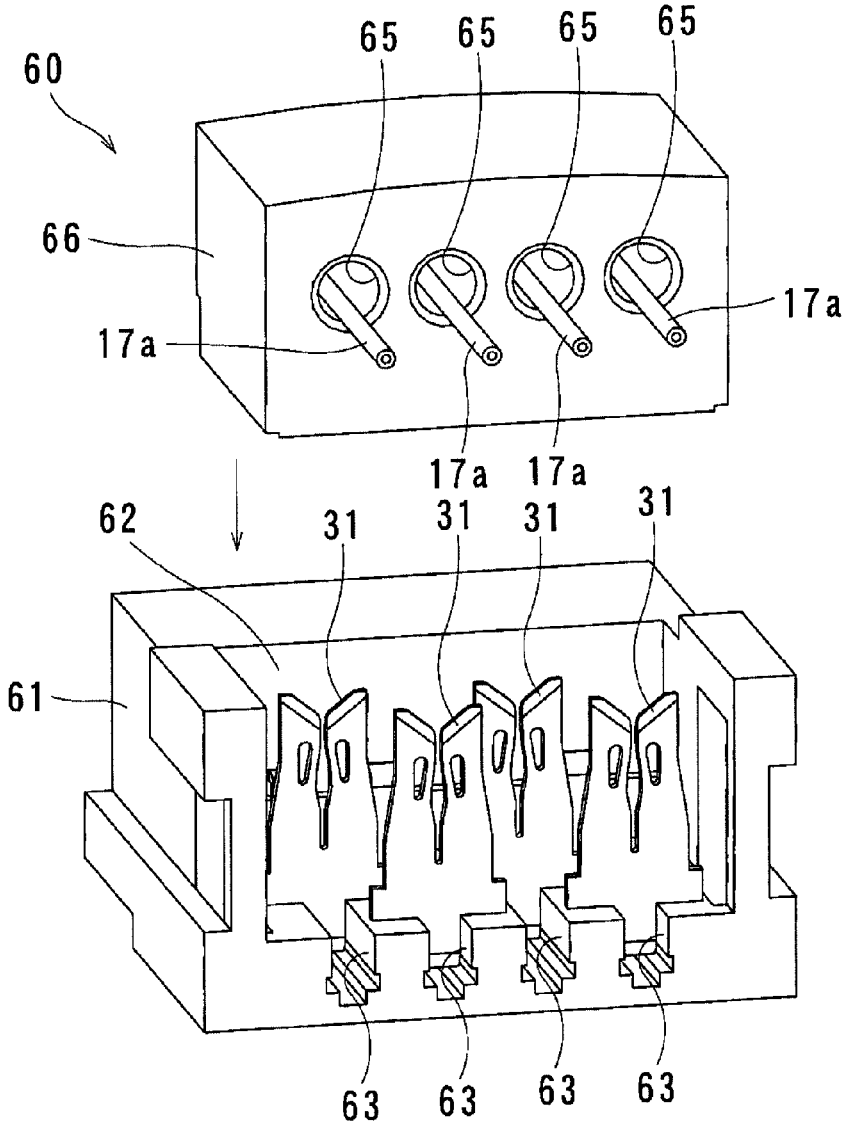
FIG. 12 is a perspective view before the electric wire is press-fitted into a housing shape connector in which the pressure welding terminals according to the first embodiment are assembled.

It should be noted that although the pressure welding terminals 31, 51 are applied to the connector 10 including the plug 11 and the socket 21 in the above embodiments, the present invention is not limited to this. For example, as shown in FIG. 12, the pressure welding terminals 31 may be applied to a connector 60 including a housing 61. This connector 60 has the box shape housing 61 having a recessed portion 62, and an electric wire retaining member 66 inside which retaining holes 65 for retaining electric wires 17 are provided. The plurality of pressure welding terminals 31 of the present invention is placed in fixing grooves 63 formed in a bottom part of the housing 61.

Figure 13A:
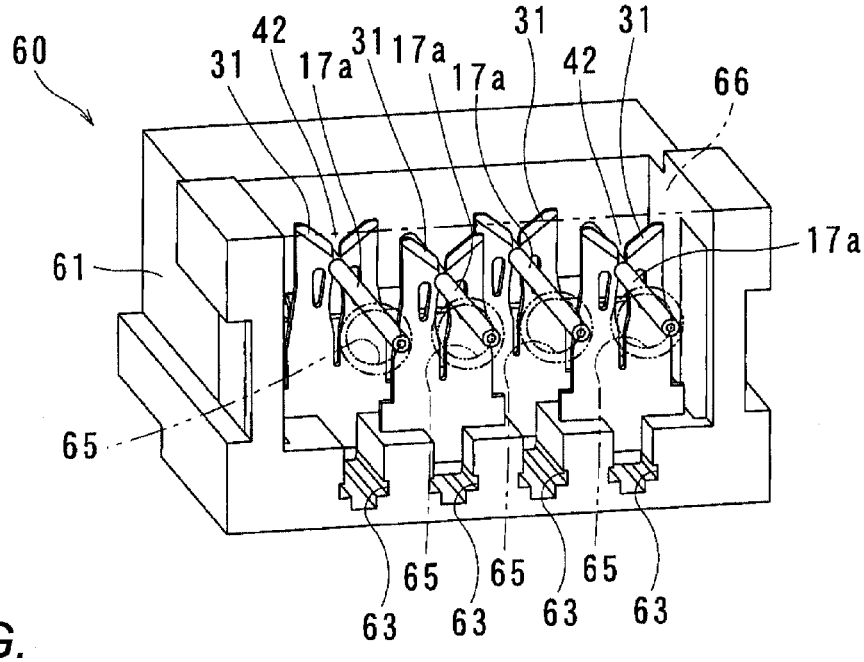
FIG. 13A is a perspective view of a state that an electric wire having a small diameter is press-fitted into the pressure welding terminal of FIG. 12.

As shown in FIG. 13A, in the case where electric wires 17*a* having a small diameter are pressure-welded to the pressure welding terminals 31, by press-fitting the electric wire retaining member 66 into the recessed portion 62 of the housing 61, the electric wires 17*a* are press-fitted into the pressure welding terminals 31 and retained in upper ends of inner peripheral surfaces of the retaining holes 65.

Figure 13B:
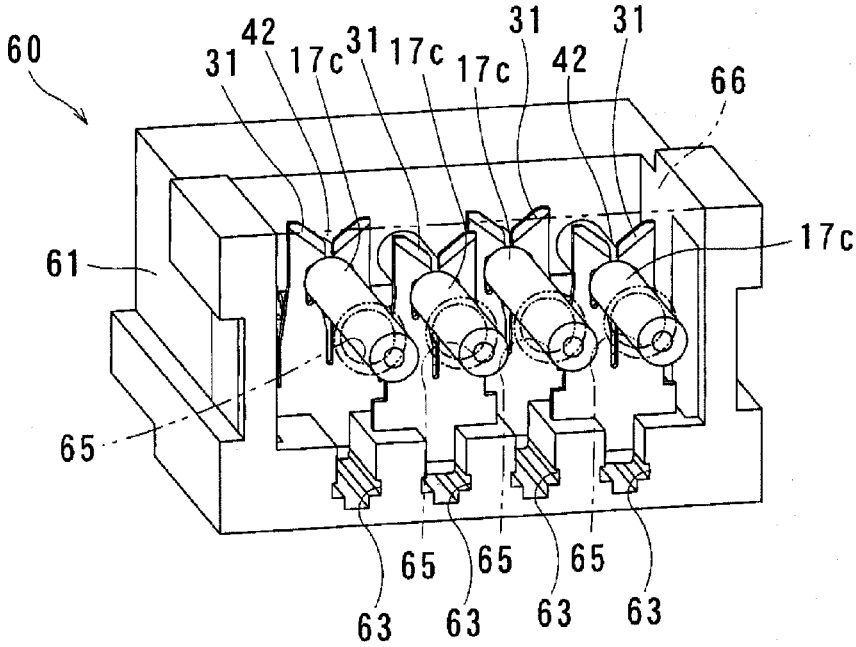
FIG. 13B is a perspective view of a state that an electric wire having a large diameter is press-fitted into the pressure welding terminal of FIG. 12.

Similarly, as shown in FIG. 13B, in the case where electric wires 17*c* having a large diameter are pressure-welded to the pressure welding terminals 31, by press-fitting the electric wire retaining member 66 into the recessed portion 62 of the housing 61, the electric wires 17*c* are press-fitted into the pressure welding terminals 31 and retained in the upper ends of the inner peripheral surfaces of the retaining holes 65. Therefore, even when any of the electric wires 17*a* having a small diameter and the electric wires 17*c* having a large diameter are press-fitted into the pressure welding terminals 31, the electric wires are pushed in from the openings 42 of the pressure welding terminals 31 by a predetermined distance and pressure-welded and retained. In such a way, there is no need for changing the push-in amount in accordance with a diameter difference of the electric wires 17 or preparing a plurality of pressure welding terminals 31 of different pressure welding forces. Thus, there is no need for changing a shape of the housing 61 in correspondence with the diameter of the electric wires 17 or preparing jigs for pushing the electric wires 17.

As long as a plurality of types of electric wires having different diameters can be pressure-welded by one type of pressure welding terminal, the present invention is not limited to the above embodiments as a matter of course.

There has thus been shown and described a pressure welding terminal which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A pressure welding terminal comprising:

a pair of spring portions;

a slit for press-fitting and retaining a conductive body disposed between said pair of spring portions by a fixed push-in amount, an upper edge of the conductive body retained by the slit being disposed at a fixed position from an opening of the slit, wherein a region is provided where an area of a cross-section of at least one of the spring portions on a lower side of the upper edge of the conductive body is smaller than an area of a cross-section of the at least one spring portion at a position of the upper edge of the conductive body.

2. The pressure welding terminal according to claim 1, wherein the slit includes a first slit having an opening in one end, and a second slit extending from an other end of the first slit and widening toward a far side thereof.

3. The pressure welding terminal according to claim 2, wherein a hole portion extending along the slit is provided, and a pressure welding portion for pressure-welding the conductive body is formed between the hole portion and the slit.

4. The pressure welding terminal according to claim 2, including a narrow neck portion cut out, inward from an outer edge of the spring portion, and a pressure welding portion for pressure-welding the conductive body is formed on an upper side of the narrow neck portion.

5. The pressure welding terminal according to claim 1, wherein a hole portion extending along the slit is provided, and a pressure welding portion for pressure-welding the conductive body is formed between the hole portion and the slit.

6. The pressure welding terminal according to claim 1, including a narrow neck portion cut out inward from an outer edge of the spring portion, and a pressure welding portion for pressure-welding the conductive body is formed on an upper side of the narrow neck portion.

7. A connector comprising the pressure welding terminal according to claim 1.

8. A connector comprising the pressure welding terminal according to claim 2.

9. A connector comprising the pressure welding terminal according to claim 3.

10. A connector comprising the pressure welding terminal according to claim 4.

11. A connector comprising the pressure welding terminal according to claim 5.

12. A connector comprising the pressure welding terminal according to claim 6.

13. The connector of claim 7, further comprising a plug including the pressure-welding terminal and a socket couplable to the plug, the socket including a cable retaining body defining at least one retaining groove to receive the conductive body at an upper end of the at least one retaining groove such that when the plug and the socket are coupled together, the conductive body is received in the slit by the fixed push-in amount.

14. A pressure welding terminal, comprising:

a pair of spring portions;

a slit defined between the spring portions and including a slit opening for receiving a conductive body having a diameter and a first edge that is closest to the slit opening, the conductive body being disposed in a socket operable to engage the pressure welding terminal such that the first edge of the conductive body is received in the slit a predetermined distance from the slit opening regardless of the diameter of the conductive body positioned within the slit;

wherein a cross-sectional area of at least one of the spring portions taken at a first location at the first edge of the conductive body has a greater cross-sectional area at such first location than a cross-sectional area of the at least one spring portion taken at a second location at a second edge of the conductive body opposite the first edge, not including the cross-sectional area of any hole portions at the second location.

* * * * *